US006292579B1

(12) United States Patent
Hutchinson

(10) Patent No.: US 6,292,579 B1
(45) Date of Patent: Sep. 18, 2001

(54) DOCUMENT VALIDATOR HAVING AN INDUCTIVE SENSOR

(75) Inventor: Derek Hutchinson, Berkshire (GB)

(73) Assignee: Mars Incorporated, McLean, VA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/020,933

(22) Filed: Feb. 9, 1998

(51) Int. Cl.[7] ..... G06K 9/00
(52) U.S. Cl. ..... 382/135; 382/139; 382/320
(58) Field of Search ..... 382/175, 319, 382/320, 135, 139; 194/207; 356/71

(56) References Cited

U.S. PATENT DOCUMENTS

| | | | | |
|---|---|---|---|---|
| 3,692,929 | * | 9/1972 | Hirashima | 178/5.4 |
| 3,870,629 | | 3/1975 | Carter et al. . | |
| 4,348,656 | * | 9/1982 | Gorgone et al. | 340/146 |
| 4,536,709 | | 8/1985 | Ishida . | |
| 4,593,184 | | 6/1986 | Bryce et al. . | |
| 4,973,851 | * | 11/1990 | Lee | 250/556 |
| 5,151,607 | | 9/1992 | Crane et al. . | |
| 5,222,584 | | 6/1993 | Zouzoulas . | |
| 5,308,992 | | 5/1994 | Crane et al. . | |
| 5,418,458 | | 5/1995 | Jeffers . | |
| 5,434,427 | | 7/1995 | Crane et al. . | |
| 5,473,147 | | 12/1995 | Hoshino et al. . | |
| 5,489,015 | * | 2/1996 | Wood | 194/318 |
| 5,495,929 | | 3/1996 | Batalianets et al. . | |
| 5,624,017 | | 4/1997 | Plesko . | |
| 5,855,268 | * | 1/1999 | Zoladz, Jr. | 194/207 |

* cited by examiner

*Primary Examiner*—Andrew W. Johns
*Assistant Examiner*—Seyed Azarian
(74) *Attorney, Agent, or Firm*—Fish & Richardson P.C.

(57) ABSTRACT

A document validator includes a document path along which a document is conveyed and an inductive sensor for sensing features of the document. The sensor has a first inductive element disposed on a first side of a plane of the document path and a second inductive element disposed on a second side of the plane of the document path. Circuitry coupled to an output of the inductive sensor processes signals relating to a determination of at least one of the presence, authenticity and denomination of the inserted document. The sensor need not physically contact a document, such as a banknote, as it is conveyed along the document path.

45 Claims, 6 Drawing Sheets

DOCUMENT VALIDATOR HAVING AN INDUCTIVE SENSOR

BACKGROUND

The present invention relates generally to a document validator having an inductive sensor.

Documents, such as banknotes, often include magnetic or other metallic "signatures" to help detect and prevent counterfeiting. For example, inks or dyes having magnetic properties can be printed on the banknotes. Thus, portraits appearing in the center of various U.S. bills are printed entirely with magnetic ink. Similarly, an engraving which forms the printed border of U.S. bills is printed with magnetic ink. The magnetic properties are controlled to produce a defined magnetic signature or pattern associated with genuine banknotes.

Such magnetic properties can be sensed, for example, by a banknote or bill validator. Some bill validators sense the magnetic signature associated with a banknote or other document inserted into the validator by pressing the inserted document against a magnetic head or sensor. When the magnetic sensor comes into contact with the document, the sensor detects a magnetic field produced by the ink. The detected field can be used to determine the validity of the inserted document.

However, as a result of continual contact with banknotes or other documents, the magnetic head picks up dirt and other debris. The debris can contaminate the magnetic head and degrade performance of the validator if the magnetic head is not cleaned periodically. Also, the ability of the validator to handle worn or damaged notes can be reduced when contact with the documents is required to validate the notes. Moreover, bills can become jammed in the passageway of the validator if too much pressure is applied when the banknote is pressed against the sensor.

Although the use of non-contact magnetic sensors is desirable, the fact that the intensity of the magnetic field decreases as the distance of the sensor from the banknote increases previously has limited the use of non-contact magnetic sensors in banknote or bill validators.

SUMMARY

In general, in one aspect, a document validator includes a document path along which a document is conveyed and an inductive sensor for sensing features of the document. The sensor has a first inductive element disposed on a first side of a plane of the document path and a second inductive element disposed on a second side of the plane of the document path. Circuitry coupled to an output of the inductive sensor processes signals relating to a determination of at least one of the presence, authenticity and denomination of the inserted document.

According to another aspect, a method of examining features of a document includes conveying the document along a path and sensing features of the document using an inductive sensor. The inductive sensor includes a first inductive element disposed on a first side of a plane of the path and a second inductive element disposed on a second side of the plane of the path. Signals from an output of the sensor are processed to determine at least one of the presence, authenticity and denomination of the document.

Various implementations include one or more of the following features. The inductive sensor can include a transformer-coupled oscillator. The first and second inductive elements can include coils wound around ferrite cores, such as pot-cores. The sensor can sense magnetic features of the inserted document, such as magnetic ink or conductive features of the document, such as a security thread. The oscillator can have a resonant frequency that can be selected to optimize the sensitivity of the sensor to either frequency or amplitude changes.

The inductive sensor can be positioned to sense features of the document without physically contacting the document. For example, the inductive elements can be positioned at least several tenths of a millimeter from the document path. Additionally, the inductive elements can be positioned substantially opposite one another on respective sides of the document path. The validator can include an upper housing and a lower housing, with one inductive element disposed within the upper housing and the other inductive element disposed within the lower housing. The inductive elements can be positioned to sense magnetic or conductive features near a side edge of the document parallel to its direction of travel along the document path.

The circuitry can be configured to detect a frequency or amplitude change in a signal at the sensor output. In addition, the validator can include an automatic gain control circuit to control a bias voltage on the sensor.

A processor or other controller can compare data acquired from the sensor to at least one statistically determined threshold to determine the authenticity of the document. The processor also can compare data acquired from the sensor to one or more predetermined patterns corresponding to authentic documents and determining whether the document is authentic based on the comparison. The comparison can also be used to determine the denomination of the document. In some implementations, a binary magnetic pattern on the document can be sensed. The sensed pattern can be compared to stored patterns to determine the authenticity and denomination of the document.

In some implementations, data is acquired from the sensor in the absence of a document in the document path as well as in the presence of the document in the document path. An arithmetic operation is performed that combines the data acquired in the absence and in the presence of the document. At least one of the authenticity and denomination of the document is determined based on the result of the arithmetic operation.

Two or more inductive sensors can be used in a single validator. The details of the various inductive sensors, such as their dimensions, oscillating frequencies or other features, can differ depending on the particular implementation.

Various implementations provide one or more of the following advantages. Increased sensitivity to magnetic and conductive properties of the document can be achieved. The validator can detect worn or damaged documents with improved accuracy. Magnetic and conductive features of a bill or other document can be sensed without pressing the bill against the sensor and without requiring contact between the bill and the sensor. Additionally, the resonant circuit is relatively resistant to stray magnetic fields such as the earth's magnetic field. Gaps between the sensor and the bill path can be increased so as to reduce the likelihood of documents becoming jammed in the validator and to reduce wear on the sensor.

A wide range of operating frequencies can be used to tailor the sensor for detecting documents, such as U.S. bills, which have magnetic materials on them, or for detecting documents, such as European bills, which have conductive security threads embedded in them. Moreover, the detection and processing circuitry can detect shifts in frequency, amplitude or both to determine the presence of such documents in the bill path of the validator, as well as the authenticity and denomination of the documents.

Other features and advantages will be apparent from the following description, drawings and claims.

DETAILED DESCRIPTION

Figure 1:
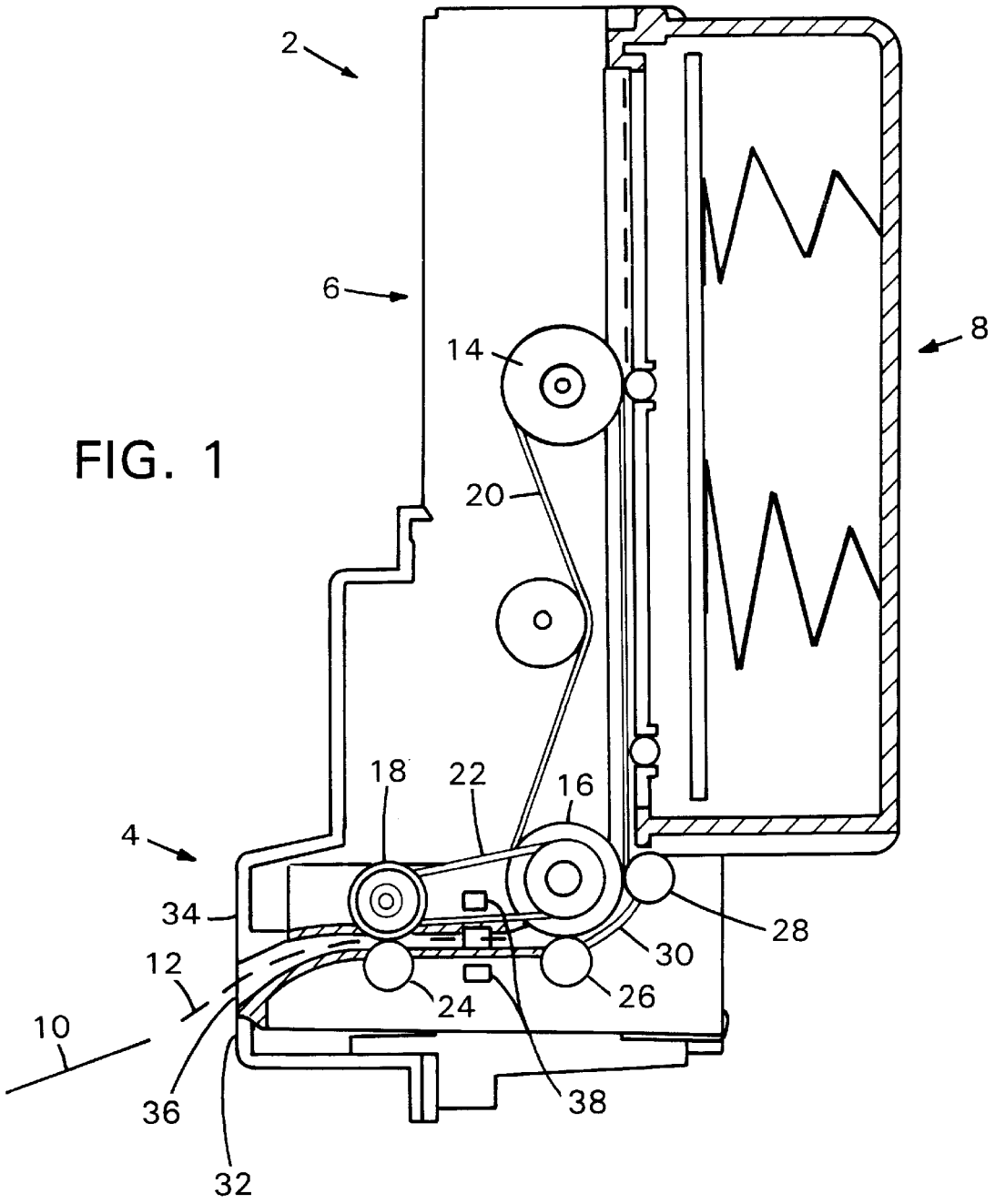
FIG. 1 is a partial cutaway side view of an exemplary document validator.

As shown in FIG. 1, an exemplary bill validator 2 includes a validation portion 4, a transport and stacking portion 6, and a cassette portion 8. The path of a bill or other document 10 through the validator 2 is indicated by the dotted line 12. Various features and details of the validator 2 are described, for example, in U.S. Pat. No. 5,632,367, assigned to the assignee of the present invention and incorporated herein by reference in its entirety.

On one side of the bill path 12, for example, above the bill path, the transport system includes various pairs of driven rollers 16, 18 coupled to driving rollers 14 by respective belts 20, 22. On the opposite side of the path 12, pairs of spring-loaded rollers 24, 26, 28 bear against the driven rollers 18, 20 to clamp the side edges of the bill parallel to the bill's direction of movement.

A bill 10 inserted into the validation portion 4 of the validator 2 will be engaged by the rollers 18, 24 which convey the bill past various validation sensors. The bill 10 is advanced to the rollers 16, 26, then up a curved portion 30 to the rollers 28. If the bill 10 is acceptable, it is conveyed to the rollers 14, which advance it to the end of the bill path 12 into its position for stacking in the cassette 8. If the bill 10 is unacceptable, a motor (not shown), which is controlled by a control and processing circuit such as a microprocessor, can be reversed to eject the bill.

The validation portion 4 includes a lower housing 32 and an upper housing 34 which define a bill entry 36. The housings 32, 34 include multiple optical sensors (not shown) for detecting the presence of a bill inserted into the validator 2 and for sensing various features of the bill which can be used to determine the authenticity and denomination of the bill.

Figure 2:
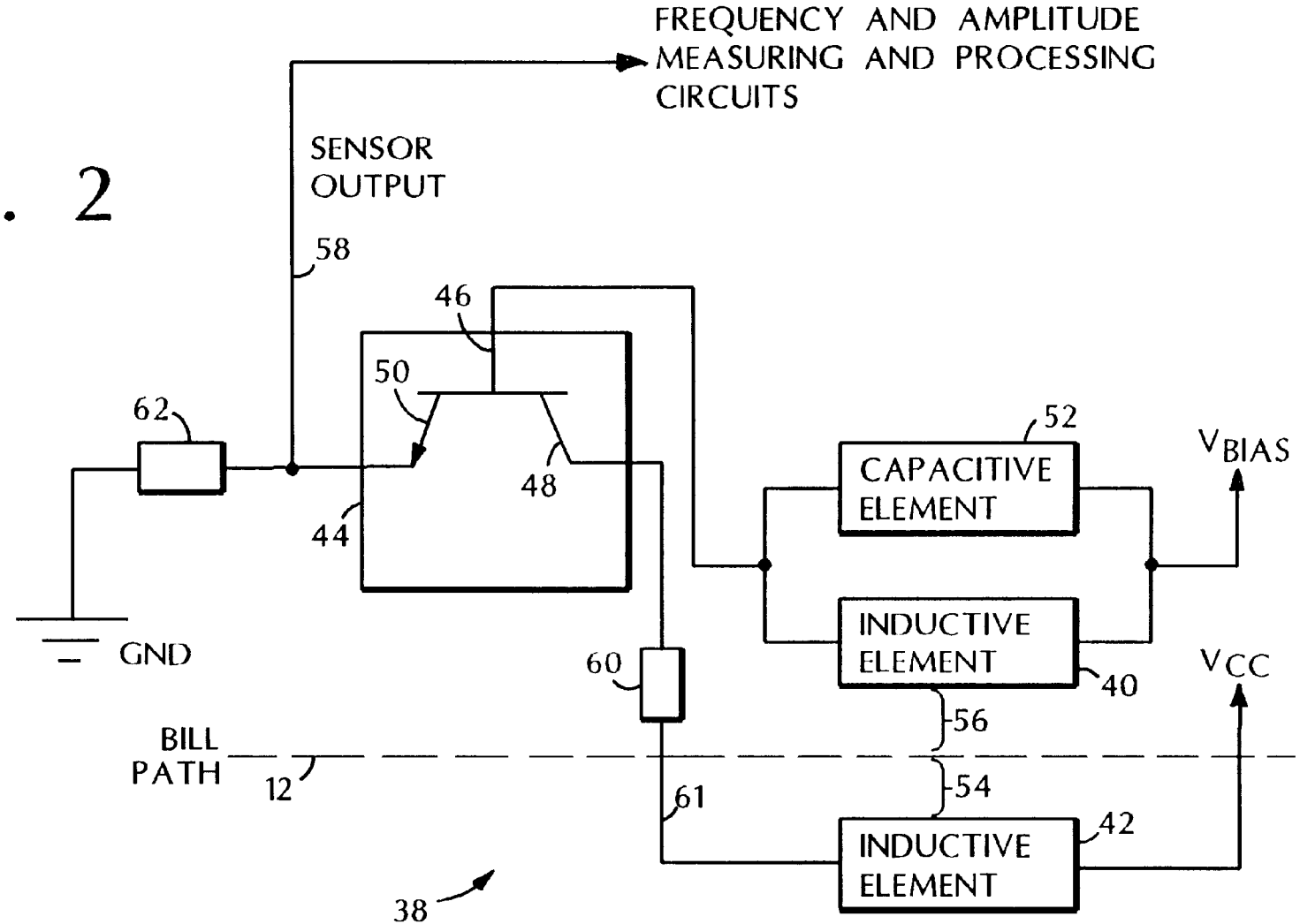
FIG. 2 is a block diagram illustrating an inductive sensor circuit for use in the document validator.

The validation portion 4 also includes an inductive sensor 38. The sensor 38 can be positioned, for example, close to the optical sensors, in other words, between the pairs of rollers 18, 24 and 16, 26. As shown in FIG. 2, the inductive sensor 38 includes a transformer-coupled oscillator which comprises a first inductive element 40 on one side of a plane formed by the bill path 12 and a second inductive element 42 on the opposite side of the bill path plane. In the implementation shown in FIG. 2, one end of the first inductive element 40 is coupled to the base 46 of a transistor 44, and the other end is coupled to a bias voltage ($V_{BIAS}$). A capacitive element 52 is coupled in parallel with the first inductive element 40. One end of the second inductive element 42 is coupled to the collector 48 of the transistor 44 through a resistive element 60 and coaxial cable 61, and the other end is coupled to a supply voltage ($V_{CC}$). The emitter 50 of the transistor 44 is coupled through a resistive element 62 to ground (GND). The resistive element 62 sets the bias current for the transistor 44. The output of the sensor 38 is taken from line 58 which is coupled to the emitter 50 of the transistor 44.

In general, the inductive elements 40, 42 are positioned opposite one another to form respective gaps 54, 56 on the order of several tenths of a millimeter (mm) or more between each inductive element and the bill path. In one implementation, the inductive element 42 is disposed within the lower housing 32 (shown in FIG. 1), and the inductive element 40 is disposed within the upper housing 34. The inductive elements 40, 42 can be mounted in the respective housings to allow the sensor 38 to detect magnetic or conductive information near a side edge of a bill that is parallel to the direction of the bill's travel as it is conveyed along the path 12.

Other sensor electronics can be mounted on a printed circuit board disposed within the upperhousing 34. Use of the inductive sensor 38 permits magnetic and conductive features of a bill or other document 10 to be sensed without pressing the bill against the inductive elements 40, 42 and without requiring contact between the bill and the inductive elements 40, 42.

During operation, the electromagnetic coupling between the inductive elements 40, 42 provides positive feedback which results in an oscillating condition. As a bill or other document 10 having conductive or magnetic material moves along the bill path 12 and passes between the inductive elements 40, 42, a phase change in the magnetic field is induced in the transformer-coupled oscillator. In response, the amplitude and frequency of oscillation change to compensate for the phase change so as to maintain an oscillating condition. Measurements of the frequency shift, the amplitude change, or both can provide an indication of the conductive or magnetic features of the document 10. Measuring and processing circuitry then can be used to process signals representing the detected features to determine or confirm the presence, authenticity and/or denomination of the document 10 based on the frequency or amplitude shift.

The inductive elements 40, 42 can take various forms, including, for example, coils wound on bobbins or ferrite cores. The shielding provided by ferrite pot-cores can help reduce interference. However, other cores, such as U-cores, C-cores and E-cores, can also be used. In one implementation, 6.5 turns of copper wire having a diameter of 0.4 mm were wound on 7 mm ferrite pot-cores to provide an inductance of 900 nano-henries (nH). In general, the size of the cores is selected as a compromise between the size of the document features to be sensed and the distance between the pot-cores. For example, in the case of a U.S. bill, if the cores are too large, the sensor 38 will sense a combination of magnetic and non-magnetic inks. If the cores are too small, leakage flux across the poles of each core become large compared to the flux across the gap between the pot-cores, resulting in poor sensing of the bill's features.

Generally, for resonant frequencies greater than about 1 megahertz (MHz), tests indicated that the magnitude of the frequency shift increases with increasing operating frequency whereas the magnitude of the amplitude shift decreases with increasing frequency. Thus, in one implementation, the frequency shift for documents containing magnetic ink was just detectable using frequencies as low as approximately 14 MHz. Resonant frequencies of approximately 25 MHz resulted in frequency shifts of approximately 12 kilohertz (kHz) and 4 kHz, respectively, when documents containing a conductive security thread and magnetic ink were sensed using 7 mm ferrite cores. Resonant frequencies greater than 25 MHz also can be used. Resonant frequencies below 14 MHz tended to provide a stronger amplitude response to documents containing conductive security threads such as those found in some European banknotes.

Figure 3:
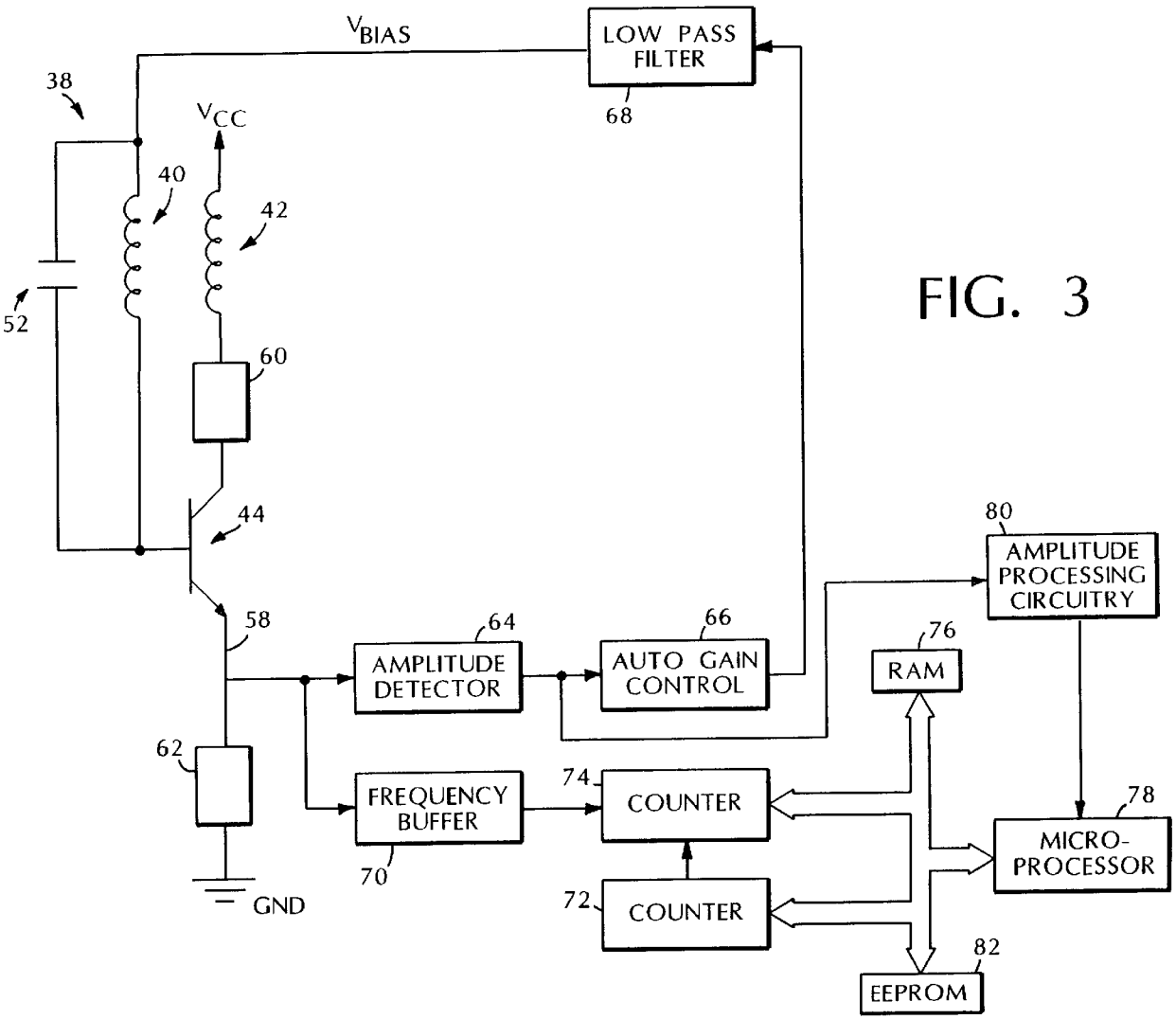
FIG. 3 is a block diagram showing additional components of the bill validator associated with the inductive sensor circuit.

As shown by FIG. 3, the output of the sensor 38 drives a frequency buffer 70 which converts the small oscillating signal at the sensor output 58 to a digital level signal. The digital signal then can be used to determine the frequency of the signal at the sensor output 58. In one implementation, for example, a first counter 72 generates a counter gating period using a 16 MHz crystal. A counter gating period of 1.792 milliseconds (ms) is generated every 2.048 ms, corresponding to approximately three samples per millimeter of a bill moving along the bill path 12. A second 16-bit counter 74 receives and counts the number of zero crossings which occurred during the counter gating period. The resulting count is transferred to memory, such as random access memory (RAM) 76 during the subsequent 0.256 ms. In this implementation, the maximum input frequency, which corresponds to overflow of the 16-bit counter 74, is 36 MHz with a resolution of 0.5 kHz.

An idle count, or air value, is determined by estimating the average number of zero crossings occurring during the counter gating period when there is no document in the vicinity of the sensor 38. As a bill is conveyed along the bill path 12 between the inductive elements 40, 42 of the sensor 38, the number of zero crossings during each counter gating period is counted and stored in the memory 76. A microprocessor 78, or other suitable processor or controller, subtracts the idle count from each count measured in the presence of the document 10. The resulting difference then can be converted to a corresponding frequency shift.

The microprocessor 78 is programmed to use any one of several known techniques to analyze the acquired data and to compare it to the magnetic or conductive features of acceptable bills or other documents. For example, the data acquired from the sensor 38 can be compared to one or more statistically determined threshold values to determine the validity of the document. Similarly, predetermined magnetic and conductive patterns of authentic bills can be stored in electrically erasable programmable read only memory (EEPROM) 82. The microprocessor 78 uses the predetermined patterns and the acquired data to determine whether the bill is authentic and, if so, the denomination of the bill. In one implementation, the sensor 38 senses a binary magnetic or conductive pattern on the bill, and the detected pattern is compared to stored patterns to determine the bill's authenticity, denomination or both. The binary pattern can be formed, for example, by alternating the presence and absence of magnetic material along the edge of the bill. The bill then can be accepted or rejected based on the results of the comparison. Other magnetic or conductive patterns also can be used.

In another implementation, the frequency measurement and processing circuit includes a phase-locked loop. For example, the inductive sensor 38 can be tuned with a varicap diode driven by a phase detector. A reference signal derived from a crystal serves as an input to the phase detector so that the idle frequency is phase-locked to the crystal. As a document with magnetic or conductive material passes between the inductive elements 40, 42, a disturbance is generated on the drive to the varicap. Thus, the frequency modulation caused by the magnetic or conductive material appears as a control voltage modulation. The disturbance is measured, for example, using an analog-to-digital (A/D) converter.

If the coupling between the inductive elements 40, 42 is relatively weak, then small perturbations in the mechanical tolerances of circuit components or changes in the environment, such as changes in the ambient temperature, can change the operating conditions of the oscillator so that it no longer oscillates. To compensate for such an occurrence, as shown in FIG. 3, an automatic gain control circuit is provided to control the bias voltage, $V_{BIAS}$, applied to the inductive element 40 to maintain the oscillating condition. In particular, the sensor output 58 at the emitter 50 drives an amplitude detector circuit 64. An output of the amplitude detector circuit 64 is coupled to an automatic gain control amplifier circuit 66. An output of the automatic gain control circuit 66 is coupled to a low pass filter 68 to control the bias voltage on the transistor 44 and maintain a substantially constant peak-to-peak voltage at the emitter 50.

The output of the amplitude detector 64 also can be coupled to amplitude processing circuitry 80 which converts the received signals to an appropriate format for further processing by the microprocessor 78. Thus, shifts in the amplitude of the output of the sensor 38 can be detected and analyzed by the microprocessor 78 to determine the authenticity and denomination of an inserted bill. Detection of amplitude shifts can be used, for example, to detect the features of certain European banknotes that contain conductive security threads. An oscillation frequency for the sensor 38 in the range of approximately 1–2 MHz has been found to provide a strong amplitude response when some of those banknotes have been tested.

Figure 4A:
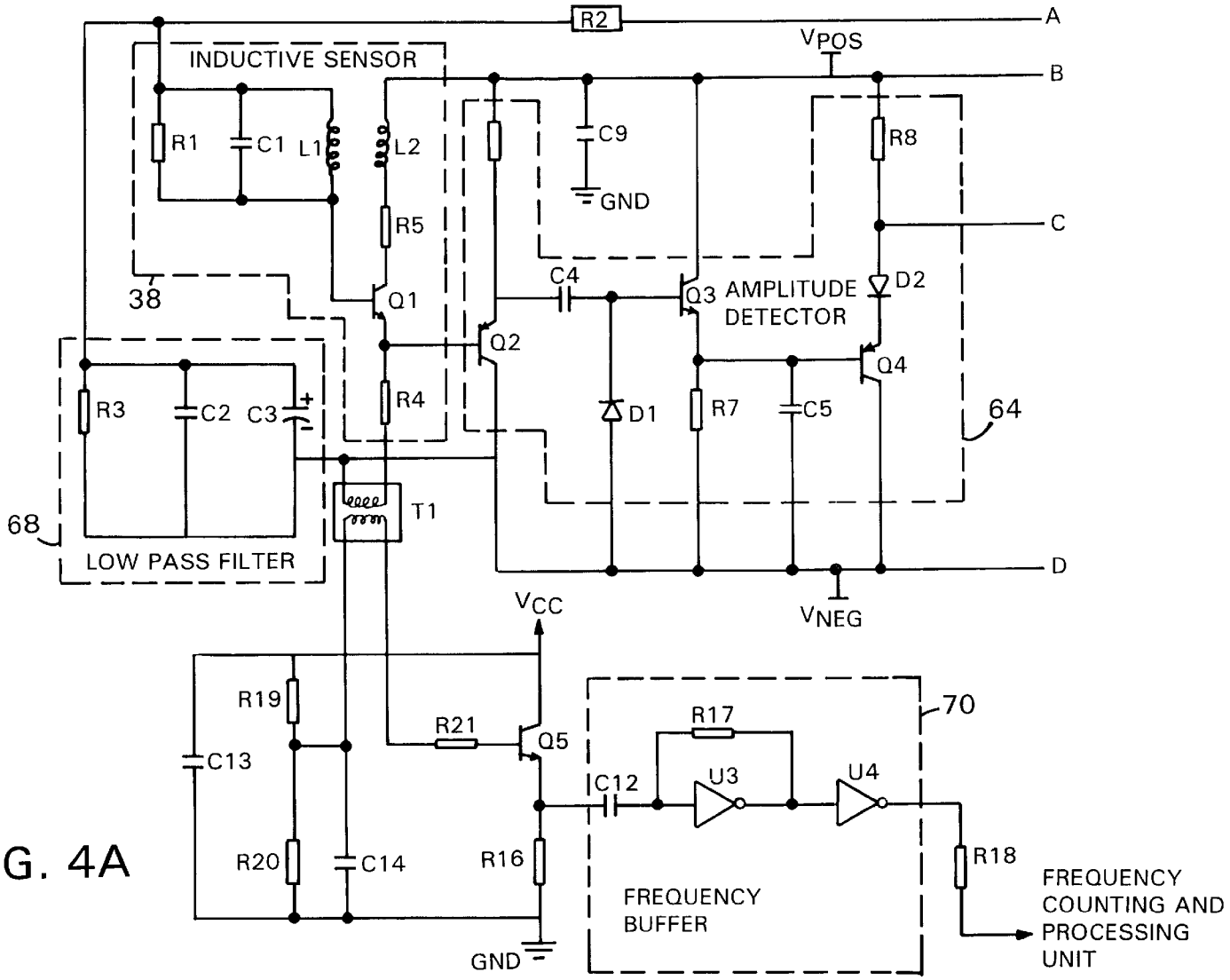
FIGS. 4A and 4B are a circuit diagram showing further details of the document validator.

FIG. 4 illustrates further details of various circuit elements according to one implementation. The inductive sensor 38 is shown as including a transmit coil L2 and a receive coil L1, as well as resistors R1, R4, R5, capacitor C1 and an NPN transistor Q1. The coils L1, L2 are wound around ferrite pot-cores, are substantially identical, and are disposed on opposite sides of the plane of the bill path 12. The drive side of the sensor 38 is coupled to the collector of the transistor Q1, and the tuned side is coupled to the base of the transistor Q1. As shown in FIG. 4A, the output of the sensor 38 is coupled by a transformer T1 and associated circuitry to the frequency buffer 70. The frequency buffer 70 includes an inverter U3 with a feedback resistor R17 and AC input coupling. Isolated power supplies are provided for the inductive sensor circuit and the frequency counting logic circuit. The output of the frequency buffer 70 then is coupled to the frequency counting and processing circuit which includes the counters 72, 74, the memories 76, 82 and the microprocessor 78, shown in FIG. 3. In alternative implementations, the input to the frequency buffer 70 can be taken directly from the emitter of the transistor Q1 or the emitter of the transistor Q2.

The output of the sensor 38 also drives the amplitude detector 64 which includes a PNP emitter follower transistor Q2, and an active diode pump comprising a diode D1 and a transistor Q3. The amplitude detector 64 also includes a PNP emitter follower transistor Q4 and a diode D2. The output of the amplitude detector 64 is coupled to additional amplitude processing circuitry, which includes an A/D converter 86 (FIG. 4B) whose output is coupled to the microprocessor 78. Thus, for example, if the amplitude of oscillation of the sensor 38 decreases due to the presence of a bill containing conductive material, the voltage at the output of the amplitude detector 64 decreases. The voltage at the output of the amplitude detector 64 is converted to a digital signal by the A/D converter 86 which the microprocessor 78 processes to determine the amplitude shift. The amplitude shifts corresponding to multiple points along the document then can be used to evaluate the authenticity and denomination of the bill.

Figure 4B:
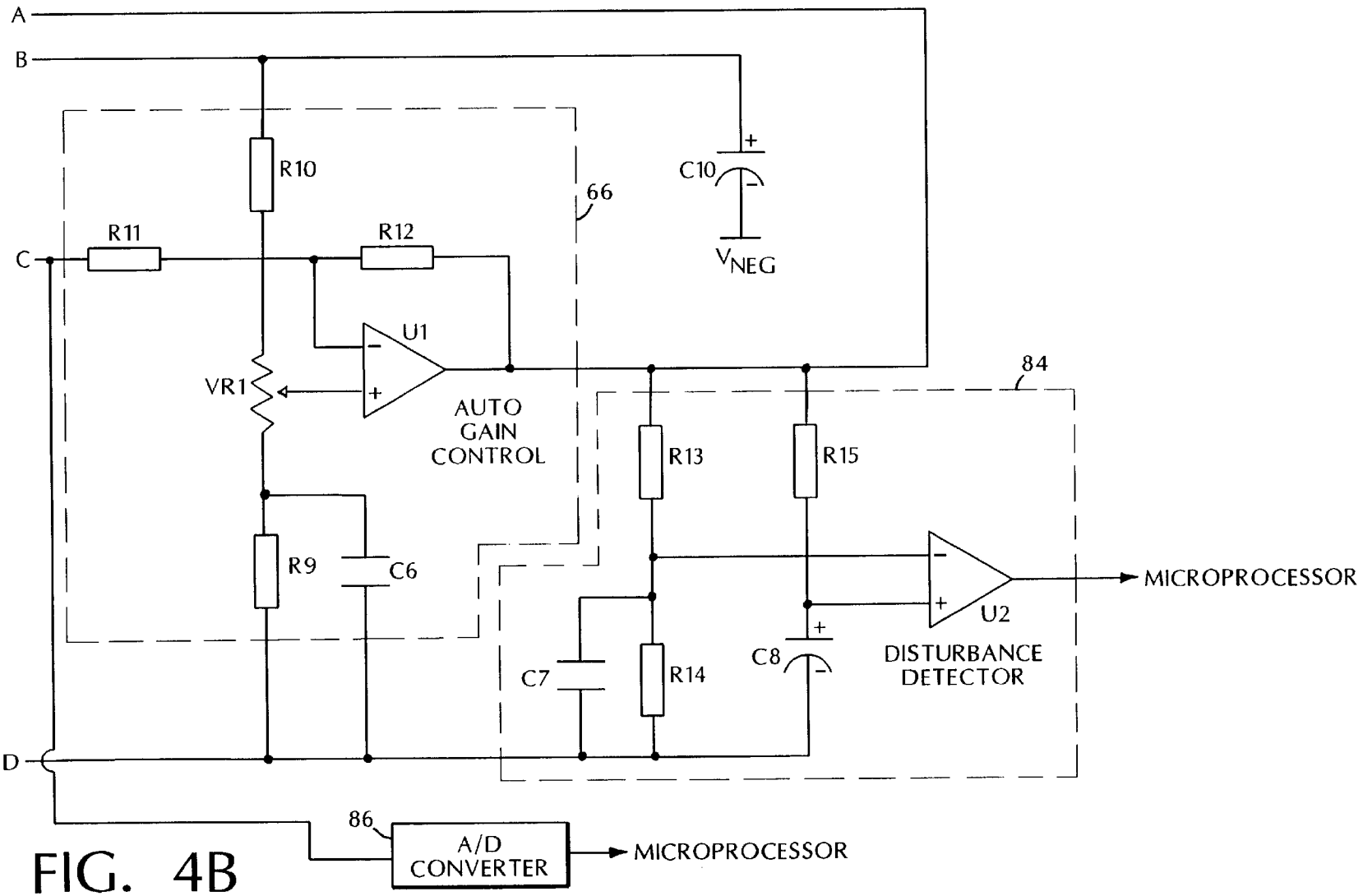

The output of the amplitude detector 64 also is coupled to the automatic gain control circuit 66. As shown in FIG. 4B, the automatic gain control circuit 66 includes an operational amplifier U1 which amplifies the offset between the output of the amplitude detector 64 and the voltage set by a potentiometer VR1. The normal setting of the automatic gain control circuit 66 provides a 2-volt bias at the base of the transmitter Q1 in the inductive sensor 38. Thus, for example, if the amplitude of oscillation in the sensor 38 decreases due to the presence of a bill containing conductive material, the voltage at the output of the amplitude detector 64 decreases, and the voltage at the output of the automatic gain control 66 rises. The bias on the transistor Q1 in the inductive sensor circuit 38 then increases, thereby increasing the amplitude of oscillation to compensate for the original decrease.

As further shown in FIG. 4B, the output of the automatic gain control circuit 66 also is coupled to a disturbance detector 84 to monitor changes at the output of the automatic gain control circuit 66. The disturbance detector 84 allows changes in the amplitude of the output of the sensor 38 to be detected indirectly. The disturbance detector 84 can be used for sensing the presence of banknotes having conductive security threads or magnetic ink. Thus, for example, when the output of the automatic gain control 66 increases, the instantaneous voltage on the capacitor C8 remains constant so that the output of the comparator U2 switches from a high signal to a low signal. The microprocessor 78 senses the low signal and interprets it as an indication that a document having conductive or magnetic features is present in the bill path.

Exemplary values of the resistors R1 through R21, the capacitors C1 through C13, and the inductors L1, L2 are listed in Table 1 below.

TABLE 1

| | | | |
|---|---|---|---|
| (R1 | R11 | R21 | C9 |
| 100 k-ohm) | 47 k-ohm | 220 ohm | 47 nF |
| R2 | R12 | C10 | |
| 1.2 k-ohm | 470 k-ohm | 4.7 uF | |
| R3 | R13 | C1 | C11 |
| 10 k-ohm | 560 ohm | 22 pF | 47nF |
| R4 | R14 | C2 | C12 |
| 1.5 k-ohm | 220 k-ohm | 47 nF | 1 nF |
| R5 | R15 | C3 | C13 |
| 120 ohm | 220 k-ohm | 270 uF | 10 nF |
| R6 | R16 | C4 | |
| 2.2 k-ohm | 220 ohm | 1 nF | |
| R7 | R17 | C5 | L1 |
| 47 k-ohm | 1 M-ohm | 10 nF | 900 uH |
| R8 | R18 | C6 | L2 |
| 5.6 k-ohm | 33 ohm | 47 nF | 900 uH |
| R9 | R19 | C7 | |
| 2.7 k-ohm | 1 k-ohm | 47 nF | |
| R10 | R20 | C8 | |
| 5.6 k-ohm | 1 k-ohm | 4.7 uF | |

For frequencies greater than approximately 10 MHz, the resistor R1 can be left out of the circuit. Thus, for example, using values of 900 nH for L1 and L2 and a value of 22 pF for C1, the circuit resonates at approximately 36 MHz. For frequencies less than approximately 10 MHz, a value of 33 pF can be used for C1 and the resistor R1 can be included in the circuit.

While many different devices are available to implement the specific circuit of FIG. 4, an LM358 device, manufactured by National Semiconductor, can be used for U1, U2, and a Philips 1N4148 device can be used for the diodes D1, D2. Similarly, a 74AC04 device, manufactured by Motorola, can be used for the inverters U3, U4 with a decoupling capacitor having a value of 47 nF connected between pins $V_{CC}$ and GND. The transistors Q1, Q3 and Q4 can be implemented using Motorola BC847B device, and the transistor Q2 can be implemented using a Motorola ZN4403 device.

Figure 5:
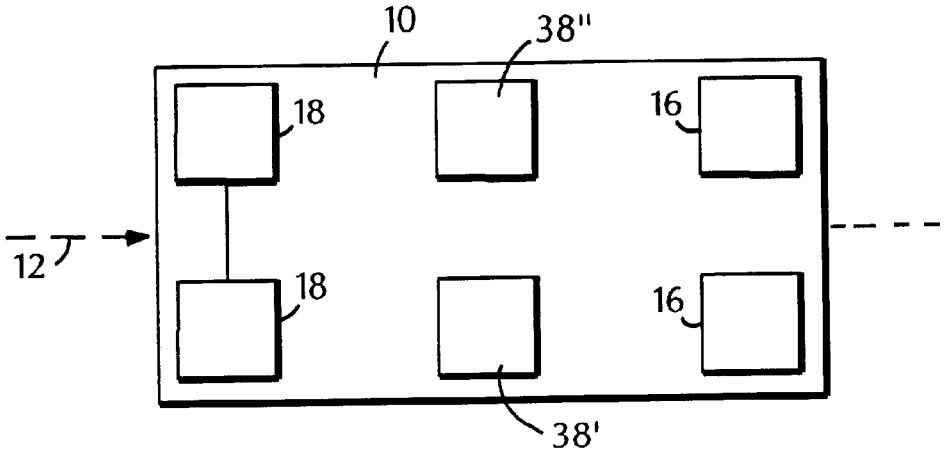
FIG. 5 is a partial top cutaway view of a document validator having multiple inductive sensors.

Multiple inductive sensors similar to the sensor 38 can be incorporated into a single document validator 2. For example, inductive sensors can be positioned along the document path 12 so that the sensors sense magnetic or conductive properties along two side edges of a document as it moves along the path. In one implementation, as shown in FIG. 5, two inductive sensors 38', 38", each of which is similar to the sensor 38, are mounted in the validator to allow detection of magnetic or conductive information near both side edges of the bill parallel to the bill's direction of travel. Detecting magnetic or conductive features along both side edges allows the present technique to be used regardless of the orientation of the bill when it is inserted into the validator. The sensors 38', 38" can be substantially identical or can differ from one another in various ways. For example, the physical dimensions of the sensors 38', 38", such as the size of the inductive elements, can differ from one another, with the larger sensor positioned to detect features along one edge of the bill and the smaller sensor positioned to detect features along the second edge of the bill. Other details of the two sensors 38', 38", such as the oscillation frequencies, also can differ depending on the particular application.

Similarly, sets of inductive sensors as described above can be positioned to sense features along one or both edges of the bill. For example, in one implementation, a large sensor and a small sensor are positioned to sense features of the bill along one edge. In another implementation, sensors having different oscillation frequencies can be positioned to sense features of the bill along one of its edges parallel to the bill's direction of travel. In other implementations, respective sets of sensors are positioned to sense features of the bill along both edges of the bill parallel to the bill's direction of travel. Each set can include, for example, a small sensor and a large sensor or sensors with different oscillation frequencies. In general, the various inductive sensors positioned along the bill path need not be substantially identical, although in some situations, using substantially similar inductive sensors can be advantageous.

Other implementations are within the scope of the following claims.

What is claimed is:

1. A document validator comprising:

a document path along which a document is conveyed;

an inductive sensor for sensing features of the document, wherein the sensor comprises a transformer-coupled oscillator including a first inductive element disposed on a first side of a plane of the document path and a second inductive element disposed on a second side of the plane of the document path to sense features of the document without physically contacting the document; and circuitry coupled to an output of the inductive sensor for processing signals relating to a phase change induced by the document to determine at least one of the presence, authenticity and denomination of the inserted document.

2. The document validator of claim 1 wherein the inductive sensor comprises a transformer-coupled oscillator.

3. The document validator of claim 1 wherein the first and second inductive elements are positioned substantially opposite one another on respective sides of the document path.

4. The document validator of claim 1 wherein the first and second inductive elements comprise coils wound around ferrite cores.

5. The document validator of claim 1 wherein the first and second inductive elements comprise coils wound around ferrite pot-cores.

6. The document validator of claim 1 wherein the circuitry is configured to detect a frequency change in a signal at the sensor output.

7. The document validator of claim 1 wherein the circuitry is configured to detect an amplitude change in a signal at the sensor output.

8. The document validator of claim 1 wherein the sensor senses magnetic features of the inserted document.

9. The document validator of claim 8 wherein the sensor senses magnetic ink on the document.

10. The document validator of claim 1 wherein the sensor senses conductive features of the document.

11. The document validator of claim 10 wherein the sensor senses a conductive security thread in the document.

12. The document validator of claim 1 wherein the first and second inductive elements are positioned at least several tenths of a millimeter from the document path.

13. The document validator of claim 1 further comprising an upper housing and a lower housing, wherein the first inductive element is disposed within the upper housing and the second inductive element is disposed within the lower housing.

14. The document validator of claim 1 wherein the inductive elements are positioned to sense magnetic features near a side edge of the document parallel to its direction of travel along the document path.

15. The document validator of claim 1 wherein the oscillator has a resonant frequency in the range of approximately 1–2 megahertz.

16. The document validator of claim 1 wherein the oscillator resonant frequency in the range of approximately 25 megahertz.

17. The document validator of claim 1 wherein the oscillator has a resonant frequency in the range of approximately 1–30 megahertz.

18. The document validator of claim 1 wherein the first inductive element is coupled to a base of a transistor, the second inductive element is coupled to a collector of the transistor, and the processing circuitry is coupled to an emitter of the transistor.

19. The document validator of claim 18 further comprising an automatic gain control circuit to control a bias voltage on the transistor.

20. The document validator of claim 1 comprising a processor programmed to compare data acquired from the sensor to at least one statistically determined threshold to determine the authenticity of the document.

21. The document validator of claim 1 comprising a processor programmed to compare data acquired from the sensor to one or more predetermined patterns corresponding to authentic documents and determine whether the document is authentic based on the comparison.

22. The document validator of claim 1 comprising a processor programmed to compare data acquired from the sensor to one or more predetermined patterns corresponding to authentic documents and determine a denomination of the document based on the comparison.

23. The document validator of claim 1 comprising a processor programmed to acquire data from the sensor in the absence of a document in the document path, to acquire data from the sensor in the presence of the document, to perform an arithmetic operation combining the data acquired in the absence and in the presence of the document, and to determine at least one of the authenticity and denomination of a document based on a result of the arithmetic operation.

24. A document validator comprising:

a document path along which a document is conveyed;

a plurality of inductive sensors for sensing features of the document, wherein each sensor comprises a transformer-coupled oscillator including a first inductive element disposed on a first side of a plane of the document path and a second inductive element disposed on a second side of the plane of the document path to sense features of the document without physically contacting the document; and circuitry coupled to outputs of the inductive sensor for processing signals relating to a phase change induced by the document to determine at least one of the presence, authenticity and denomination of the inserted document.

25. The document validator of claim 24 wherein the inductive elements of a first one of the sensors are positioned to sense magnetic features near a first side edge of the document parallel to its direction of travel along the document path, and wherein the inductive elements of a second one of the sensors are positioned to sense magnetic features near a second different side edge of the document parallel to its direction of travel.

26. The document validator of claim 25 wherein the first and second sensors have dimensions different from one another.

27. The document validator of claim 25 wherein the first and second sensors comprise transformer-coupled oscillators having different respective oscillation frequencies.

28. The document validator of claim 24 wherein the inductive elements of at least some of the sensors are positioned to sense magnetic features near a first side edge of the document parallel to its direction of travel along the document path.

29. The document validator of claim 28 wherein at least some of the sensors positioned to sense magnetic features near a first side edge of the document have dimensions different from one another.

30. The document validator of claim 28 wherein at least some of the sensors positioned to sense magnetic features near a first side edge of the document are transformer-coupled oscillators having oscillation frequencies which differ from one another.

31. The document validator of claim 24 wherein the inductive elements of a first set of the sensors are positioned to sense magnetic features near a first side edge of the document parallel to its direction of travel along the document path, and wherein the inductive elements of a second set of the sensors are positioned to sense magnetic features near a second different side edge of the document parallel to its direction of travel.

32. The document validator of claim 31 wherein at least some of the sensors in each set of sensors have dimensions which differ from dimensions of other sensors in the same set.

33. The document validator of claim 31 wherein at least some of the sensors in each set of sensors comprise transformer-coupled oscillators having oscillation frequencies which differ from oscillation frequencies of other sensors in the same set.

34. A method of sensing features of a document, the method comprising:

conveying the document along a path;

sensing features of the document using an inductive sensor comprising a transformer-coupled oscillator including a first inductive element disposed on a first side of a plane of the path and a second inductive element disposed on a second side of the plane of the path and positioned with respect to the path so that the inductive sensor senses the document features without physically contacting the document; and processing signals from an output of the sensor relating to a phase change induced by the document to determine of at least one of the presence, authenticity or denomination of the document.

35. The method of claim 34 further comprising detecting a frequency shift in the output of the sensor.

36. The method of claim 34 further comprising detecting an amplitude shift in the output of the sensor.

37. The method of claim 34 further comprising sensing magnetic features of the document.

38. The method of claim 34 further comprising sensing conductive features of the document.

39. The method of claim 34 further comprising controlling a bias voltage provided to the sensor.

40. The method of claim 34 further comprising comparing data acquired from the sensor to at least one statistically determined threshold to determine the authenticity of the document.

41. The method of claim 34 further comprising comparing data acquired from the sensor to one or more predetermined patterns corresponding to authentic documents and determining whether the document is authentic based on the comparison.

42. The method of claim 34 further comprising comparing data acquired from the sensor to one or more predetermined patterns corresponding to authentic documents and determining whether the document is authentic based on the comparison.

43. The method of claim 34 comprising:

acquiring data from the sensor in the absence of a document in the document path;

acquiring data from the sensor in the presence of the document;

performing an arithmetic operation combining the data acquired in the absence and in the presence of the document; and determining at least one of the authenticity and denomination of the document based on a result of the arithmetic operation.

44. The method of claim 34 further comprising:

sensing a binary magnetic pattern on the document; and comparing the sensed pattern to stored patterns to determine the authenticity of the document.

45. The method of claim 34 further comprising:

sensing a binary magnetic pattern on the document; and comparing the sensed pattern to stored patterns to determine a denomination of the document.

* * * * *